United States Patent [19]

Kotzur et al.

[11] 4,160,533

[45] Jul. 10, 1979

[54] CONTAINER WITH OCTAGONAL INSERT AND CORNER PAYOUT

[75] Inventors: Frank W. Kotzur, Mahopac; Ronald E. Zajac, East White Plains, both of N.Y.

[73] Assignee: Windings, Inc., Goldens Bridge, N.Y.

[21] Appl. No.: 872,018

[22] Filed: Jan. 24, 1978

[51] Int. Cl.[2] ..... B65H 49/18

[52] U.S. Cl. ..... 242/137.1; 206/397

[58] Field of Search ..... 242/129, 137, 137.1, 242/138, 163, 170–172, 159, 146; 206/389, 397, 407, 409

[56] References Cited

U.S. PATENT DOCUMENTS

| | | | |
|---|---|---|---|
| 2,554,615 | 5/1951 | Dahle | 242/146 |
| 3,677,491 | 7/1972 | Gerwig | 242/163 |
| 3,689,005 | 9/1972 | Newman | 242/163 |
| 3,877,661 | 4/1975 | Newman | 242/163 |
| 3,923,270 | 12/1975 | Newman et al. | 242/163 |
| 4,057,204 | 11/1977 | Zajac | 242/163 |

*Primary Examiner*—Leonard D. Christian

*Attorney, Agent, or Firm*—Watson, Cole, Grindle & Watson

[57] ABSTRACT

A package for retaining material wound in a figure-8 configuration and including a radial hole extending from the central core space thereof to the outer periphery thereof is enclosed in a container having a preforated corner portion for feeding material from the winding. The winding is placed within a polygonally-sided insert having opposing sides engaging the outer periphery of the winding and including a feedout tube inserted in the radial hole for feeding the inner end of the material. Opposite sides of the insert engage the inner surfaces of the container with the feedout tube being aligned with the perforated corner portion. The bottom and upper surfaces of the container include intersecting cone sections for supporting the inner windings of the material.

6 Claims, 4 Drawing Figures

14
10
12
20
36
28
22
30
38
18
26
34
24
40
32
52
46
44
50
16
42

FIG. 2
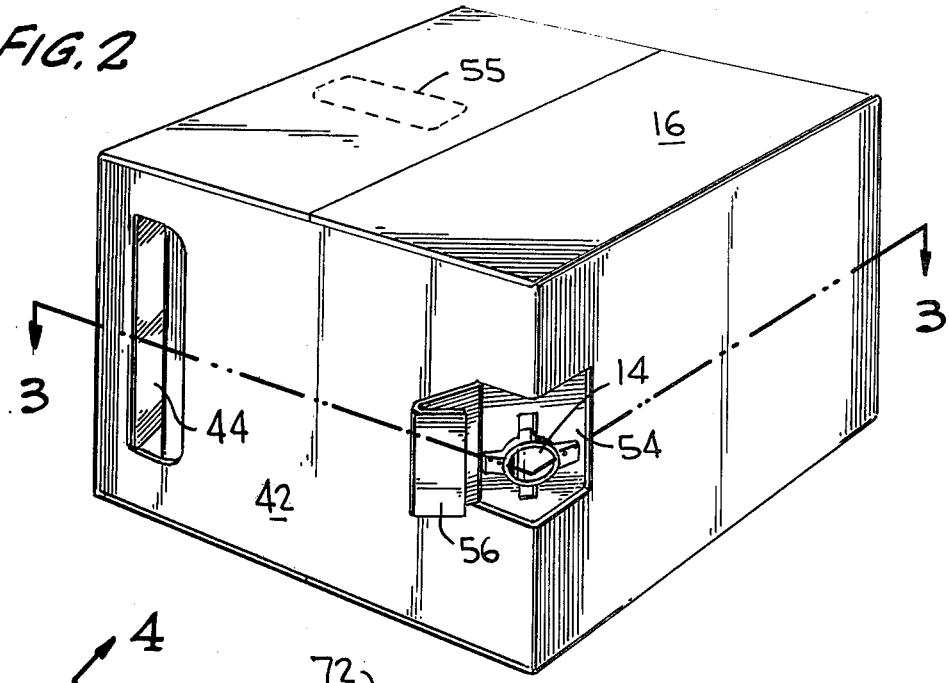
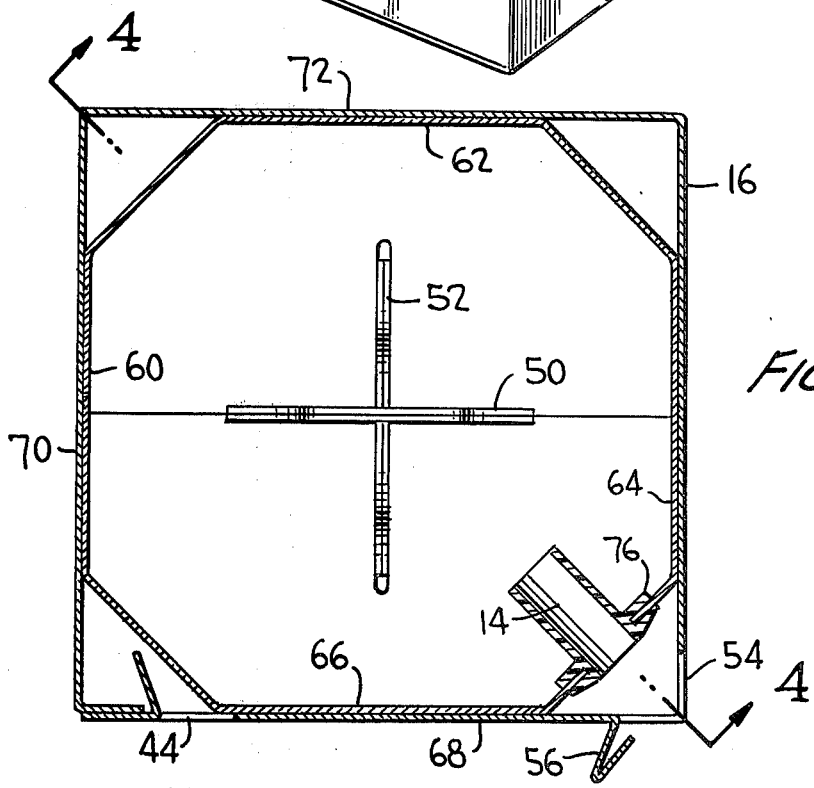
FIG. 3
FIG. 4
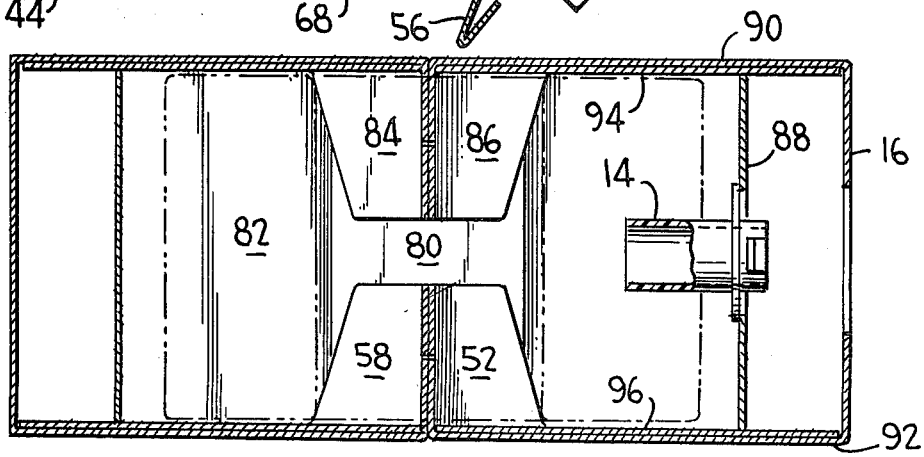

CONTAINER WITH OCTAGONAL INSERT AND CORNER PAYOUT

BACKGROUND OF THE INVENTION

1. Field Of The Invention

This invention relates to the packaging of wound material for inner end feedout through a radial opening in the winding, and in particular to such packaging in containers using inserts for retaining the wound material within the container and for providing means for unwinding the material by the inner end thereof.

2. Prior Art.

U.S. Pat. No. 3,982,712 discloses an assembly for packaging a core of wire or other strand material wherein a dispensing strip embraces the outer surface of the coil generally diametrically and includes a pair of pyramid-shaped members projecting into the central core space of the coil in opposite directions to provide support for the coil during transportation and while the package of wound material is being unwound. Material from the core of the coil is drawn through a feed tube extending radially through the windings of the coil. The coil is packaged within a container provided with a window positioned for withdrawal of the material from the coil. The coil is positioned within the container such that the dispensing strip extends from one corner of the container to another and the window is provided in one of the corners of the container aligned with the feed tube.

The packaging of wound material in containers for inner end feedout is known to the art as is the use of inserts for feeding the inner end of the wound material through a radial opening therein extending from the central core space of the winding to the outer periphery thereof. The use of cones extending into the central core space of the wound material is also known for the purpose of preventing the loops of the material from becoming entangled and to prevent birdnesting during unwinding of the material from the container or package.

With increasing use of such material unwound by inner end feedout there has arisen a need to provide improved container construction both to support and protect the winding during transport and usage, as well as to strengthen the container such that a plurality of such containers can be stacked one upon the other without breakage of either the container or damage to the contents stored within the containers.

Exemplary prior art which provides cones for supporting the windings is described in U.S. Pat. Nos. 3,677,491, 3,689,005 and 3,877,661, all of which are assigned to the same Assignee as the present application.

SUMMARY OF THE INVENTION

A coil having FIG.-8 winds and with a radial opening extending from the central core space thereof to the outer periphery of the winding is positioned within the inside of a polygonally-shaped insert having a diameter such that opposing sides of the polygonal engage the outer periphery of the winding. A hole is provided in a side of the polygonally-shaped insert and a tube insert is inserted within the hole extending in the direction of the central portion of the insert. When the wound coil is positioned within the insert the tube extends into the radial opening of the coil. The insert with the coil mounted therein as described above is then mounted within a container having dimensions such that the insert contacts the four sides of the container when it is mounted therein. An octagonally-shaped insert is thus suitable for the purposes of the present invention when used with a four-sided container, although other sided polygonals can also be used. The box contains a perforated portion at a corner thereof opposite the tube insert such that the inner end of the winding may be led out the opening formed by the perforation such that the material therein can be unwound from its inner end. The bottom and top inner surfaces of the box are formed into intersecting trapezoidally-shaped members which extend into the central core space from the upper and lower surfaces of the container respectively to support the coil as it is fed from the inner end of the wound material. The trapezoidally-shaped members are formed on each flap of the box container such that when the flaps are folded down to form the bottom and top surfaces of the container the trapezoidally-shaped members intersect in the form of a cross.

The container also may include a cutout portion which forms a handle such that the container can be conveniently carried and transported. Provision may also be made for the formation of a perforated strip which can be removed from the top of the container such that the amount of material within the container can be determined.

The insert provides additional support for the container along the four outer edges thereof as well as the top and bottom surfaces as it contacts each of the four outer surfaces and the top and bottom surface of the container. The cones which extend into the central core space from above and below also provide the necessary support for the inner windings as they are unwound in order to prevent them from becoming entangled or birdnesting.

BRIEF DESCRIPTION OF THE FIGURES

FIG. 2 is a perspective view of the closed container illustrating the handle and opened window diametrically opposite the insert through which the wound material is fed from its inner end;

FIG. 3 is a top view of the container with the insert mounted therein illustrating the relationship of the insert to the container and the cones formed at the bottom portion of the container; and FIG. 4 is a cross-section taken along lines 4—4 of FIG. 3 and showing the relationship of the insert to the container and the upper and lower cone formations.

DETAILED DESCRIPTION

Figure 1:
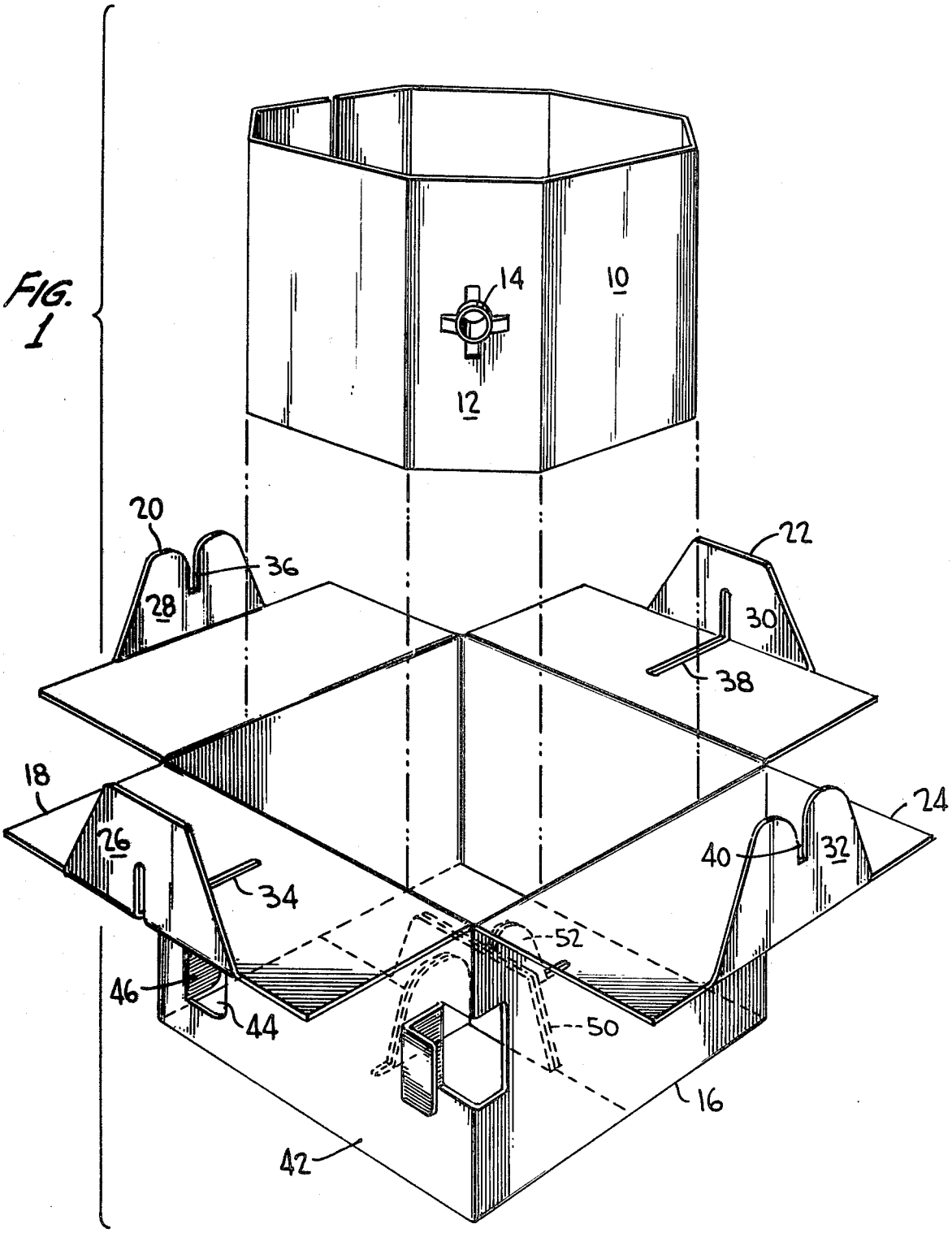
FIG. 1 is a perspective view of the container showing the top portion open and the insert removed from the container.

As illustrated in FIG. 1, octagonally-shaped insert 10 includes a side surface 12 in which is mounted a tube extending in the direction of the central region of the insert and through the radial opening of a coil of material from the outer periphery thereof to the central core space thereof. The tube may be as described in U.S. Pat. No. 4,057,204 which is assigned to the same Assignee as the present application. The insert 10 is formed preferably of corrugated material which is normally used in the container industry.

Container 16 is also formed of corrugated material and includes flap members 18, 20, 22 and 24 which include respective flap portions 26, 28, 30 and 32 each in the form of a trapezoid with rounded corners to prevent the material from catching thereon, and each including respective slots 34, 36, 38 and 40 formed as illustrated in the flap and trapezoidally-shaped flap portions. The side surface 40 of container 16 includes a cutout portion 44 with flap 46 pushed inwardly to form a convenient means of gripping the container to carry it and transport the container during its usage. The bottom surface 48 of container 16 includes pairs of intersecting trapezoidally-shaped projections 50 and 52 which are similar to those previously described with regard to the upper portion of the container.

FIG. 2 shows the closed container 16 and insert 10 mounted therein with window 54 formed by opening flap 56 provided in the corner of the container. The insert is mounted in the container such that tube insert 14 is diametrically opposite and aligned with window 54. FIG. 2 also illustrates the handle 44 formed in the side surface 42 of the container. Perforated strip 55 may be provided in the top surface of container 16 to provide a visual means of determining the amount of material within the container when the strip is removed.

The top view of the container as illustrated in FIG. 3 shows the engagement of sides 60, 62, 64 and 66 of insert 10 with respective side 68, 70, 72 and 74 of container 16. Tube insert 14 extends inwardly from side 76 of insert 10 towards the center of the container and is aligned with window 54 in the container. Cone members 50 and 52 formed by the intersecting trapezoidally-shaped flap portions of the bottom surface of the container are also illustrated in the Figures.

The wound coil consisting of a number of FIGURE-8 windings with a radial open extending from the central core space therein to the periphery of the winding is formed in a manner known to those skilled in the art, for example as set forth in U.S. Pat. No. 3,178,130, also assigned to the same Assignee as the present application. The coil of such wound material is first inserted into the insert 10 such that the radial opening is aligned with the opening in side surface 12 of the insert. Tube insert 14 is then inserted into the opening and into the radial opening of the winding. The winding and insert are then placed in the container 16 such that the central core space of the winding fits over cone members 50, 52 such that the insert is positioned within the container as illustrated in FIG. 3. The upper flaps 20, 22, 24 and 26 are then folded over to close the container and provide the additional cone members extending into the central core space of the winding opposite the cone members 50, 52.

When the container is assembled, the cone members 50, 52 extend into the central core space 80 of winding 82 as illustrated in FIG. 4. Cone members 84, 86 extend from the upper surface of the container 16 into the central core space 80 of the winding. Tube insert 14 extends from side surface 88 of insert 10 into the radial opening formed within the winding 82. FIG. 4 also illustrates the manner in which the upper surface 90 and lower surface 92 of container 16 are supported by the respective upper surface 94 and 96 of the insert.

What is claimed is:

1. A package for retaining wound material, comprising:

a container enclosing material wound in a FIGURE-8 configuration and including a radial hole extending from the central core space thereof to the outer periphery thereof, said container including a perforated portion in a corner thereof for feeding material from the winding;

a polygonally-sided insert having opposing sides engaging the outer periphery of the winding and including a feedout tube inserted in said radial hole for feeding the inner end of the material and having opposing sides engaging the inner surfaces of the container, said feedout tube being aligned with said perforated hole; and said container including bottom and upper surfaces each having intersecting cone sections for supporting the inner windings of said material.

2. A package as in claim 1 wherein said container further includes a cutout portion forming a handle for transporting the package.

3. A package as in claim 1 wherein said polygonally-sided insert is an octagon and the lower and upper edge portions of the insert respectively engage the bottom and upper surfaces of the container.

4. A package as in claim 1 wherein the bottom and upper surfaces of the container are formed of folded flap sections each including a trapezoidally-shaped projection and transverse slits extending along each flap section and into the respective trapezoidally-shaped sections, said flap sections forming the bottom and upper surfaces of the container and the trapezoidally-shaped sections forming said intersecting cone sections.

5. A package as in claim 1 wherein the top surface of said container includes a perforated strip for enabling observation of the contents of the package.

6. A package as in claim 2 wherein said polygonally-sided insert is an octagon and the lower and upper edge portions of the insert respectively engage the bottom and upper surfaces of the container;

the bottom and upper surfaces of the container are formed of folded flap sections each including a trapezoidally-shaped projection and transverse slits extending along each flap section and into the respective trapezoidally-shaped sections, said flap sections forming the bottom and upper surfaces of the container and the trapezoidally-shaped sections forming said intersecting cone sections; and the top surface of said container includes a perforated strip for enabling observation of the contents of the package.

* * * * *